United States Patent [19]

Kaiser

[11] Patent Number: 5,014,965

[45] Date of Patent: May 14, 1991

[54] PROCESS AND APPARATUS TO CLEAN A MOLTEN METAL OR SLAG CONVEYOR TROUGH

[75] Inventor: Heinrich Kaiser, Salzgitter, Fed. Rep. of Germany

[73] Assignee: Stahlwerke Peine-Salzgitter AG, Peine, Fed. Rep. of Germany

[21] Appl. No.: 505,050

[22] Filed: Apr. 4, 1990

[51] Int. Cl.[5] ..... C21B 9/10

[52] U.S. Cl. ..... 266/44; 266/281; 266/135

[58] Field of Search ..... 266/45, 44, 281, 280, 266/135, 78, 287; 264/30

[56] References Cited

U.S. PATENT DOCUMENTS 4,871,211 10/1989 Aussel ..... 266/281
4,923,180 5/1990 Eitel ..... 266/281

FOREIGN PATENT DOCUMENTS 3225015 11/1983 Fed. Rep. of Germany .
689771 1/1930 France .
2037007 4/1969 France .

*Primary Examiner*—S. Kastler
*Attorney, Agent, or Firm*—Thomas N. Ljungman

[57] ABSTRACT

A process and apparatus to clean refractory-lined conveyor troughs for molten metals and slags by means of chains on a rotating drum. A motor is used to drive the drum, whose current consumption and/or speed are variable as a function of the load. Variation from a specified setpoint is used to cause a displacement of the rotating drum transverse to the conveyor trough, to achieve optimal cleaning of the trough wall, which is only effected with the desired distance between wall and drum and a load on the motor corresponding to this distance. The direction of rotation of the drum is reversible, so that when the two sides of the conveyor trough are cleaned, the material removed is thrown in the same direction, preferably towards a suction exhaust.

16 Claims, 2 Drawing Sheets

PROCESS AND APPARATUS TO CLEAN A MOLTEN METAL OR SLAG CONVEYOR TROUGH

BACKGROUND OF THE INVENTION

1. Field of the Invention

This invention relates to an improved process and apparatus to clean refractory-lined conveyor troughs for molten metals and slags, in particular in blast furnaces, where cleaning is accomplished by means of rotating chains.

2. Background Information

German Patent No. 32 25 015, discloses an apparatus to clean refractory-lined conveyor troughs by means of chains circulating on a rotating drum. As described, a continuously adjustable motor is used to drive the drum. By changing the speed, the intensity of the cleaning of the wall of the conveyor trough can be influenced, but it is difficult to know in advance what amount of cleaning is necessary at which spots. In any case, merely changing the speed is not sufficient to remove some deposits, compensate for different amounts of worn refractory material to be removed, or to scour the trough wall. Since a significant amount of dust is produced by the cleaning process, measures are also necessary to ensure satisfactory operation in spite of the dust.

OBJECTS OF THE INVENTION

The object of the present invention is to provide a process to clean refractory lined conveyor troughs for molten metals and slags, in particular using an improvement of the apparatus such as is disclosed in German Patent No. 32 25 015, by means of which the cleaning process and the cleaning result on the trough lining are improved. An additional object of this invention is to provide an apparatus to perform this improved process.

SUMMARY OF THE INVENTION a process for cleaning refractory-lined conveyor troughs for molten metals and slags using chains that are located on a rotating drum carried by a rail guided undercarriage, with the drum driven by a motor and being adjustable both in height and lateral position relative to the wall of the trough, includes providing a motor for driving the drum which is variably operable as a function of the load on the motor resulting from resistance offered by contact of the chains with the material of the conveyor trough wall. The change in resistance offered to the chains by the material is measured and the rotating drum transversely displaced relative to the wall of the container in response to the change in resistance, so as to achieve optimal cleaning of the conveyor wall.

The motor may be variably operable depending upon various factors, such as where current absorption of the motor varies as a function of the load on the motor resulting from the resistance offered the chains, or where the speed of the motor driving the drum varies as a function of the load on the motor resulting from said resistance.

The apparatus has a rotating drum with chains for contact with the wall of the tough, the drum carried by a column driven by a motor, and adjustable in height and lateral position relative to the wall of the trough, with the motor being a variably operable motor responsive to the load resulting from resistance offered to the chains by the material of the conveyor trough wall contacted by the chains during the rotation of the drum. A means for measuring a load-dependent factor of the motor cooperates with an electrical control circuit, the electrical control circuit being responsive to a measurement signal from the motor driving the drum and transmitting a signal to a motor for automatic transverse displacement of the drum relative to the wall of the trough.

The motor for driving the drum is preferably a squirrel cage motor located on a vertically movable sled carrying the rotatable drum, and the drum is reversible in direction of rotation, with round link chains used both for vertical movement of the sled and transverse movement of column.

One aspect of the invention resides broadly in a process for cleaning refractory-lined conveyor troughs for molten metals or slags by means of chains which are located on a rotating drum carried by a rail-guided undercarriage. The rotating drum is driven by a motor and adjustable in height and lateral position relative to a wall of the trough. The improvement comprises a motor for driving the drum that is variably operable as a function of the load on the motor resulting from resistance offered to the chains by the material of the conveyor trough wall being contacted by the chains during rotation of the drum which measures the change in resistance offered to the chains by the material and transversely displacing the rotating drum relative to the wall of the conveyor trough a predetermined distance in response to the change in resistance so as to achieve optimal cleaning of the conveyor wall.

Another aspect of the invention resides broadly in an apparatus for cleaning refractory-lined conveyor troughs for molten metals or slags having a rotatable drum with chains troughs for contact with the wall of the trough. THe rotatable drum is driven by a motor and adjustable in height and lateral position relative to a wall of the trough. The apparatus has an undercarriage moveable longitudinally along the conveyor trough, and a column moveable transversely on which the rotatable drum is carried and along which the height of the drum can be adjusted. The improvement comprises a variably operable motor for driving the drum, the motor responsive to the load resulting from resistance offered to the chains by the material of the conveyor trough wall contacted by the chains during rotation of the drum.

BRIEF DESCRIPTION OF THE DRAWINGS

Details of the apparatus and of the process are described below, with reference to the accompanying drawings of a preferred embodiment, wherein.

DESCRIPTION OF THE PREFERRED EMBODIMENTS

According to the present invention, a drum is driven by a motor whose current consumption and/or speed vary as a function of the load. The ends of the chains striking the walls of the conveyor trough or being dragged along it represent a load on the motor. From this load, which can be measured by means of the current consumption, for example, the distance between the drum and the conveyor trough wall can be measured. As long as the refractory material on the surface of the trough wall is worn and crumbly, it can be knocked off relatively easily by the chains. But if the refractory material is in relatively good condition, it offers greater resistance to the chains. It is advantageous to have the chains strike the trough wall in an almost fully extended position, so that the material to be removed is removed by the impact of the chain ends. To drive the drum, therefore, preference is given to squirrel cage motor, whose current consumption can be continuously measured by an amperemeter. Preferably, the variation of the current consumption is corrected by displacing the rotating drum transverse or laterally to the conveyor trough, to obtain the distance and, thus, also a corresponding current consumption desired for an optimal cleaning of the conveyor trough wall. Instead of the power consumption, the speed of rotation or another load-dependent factor could also be specified and monitored.

The value, which essentially corresponds to the distance between the drum and the conveyor trough wall, can be transmitted as a measurement signal to an electrical control circuit, in which control pulses are generated for the automatic transverse displacement of the drum to achieve the desired effect, and in particular, to match the sometimes irregular curvature of the trough wall.

On conveyor troughs, and on blast furnaces in particular, there is usually a suction exhaust apparatus to extract gases, smoke and dust during operation of the trough. For the present cleaning process, it has proven advantageous to rotate the drum toward the suction exhaust while cleaning the two long sides of the trough, and to suck out the dust which is formed. For that reason, the direction of rotation of the drum drive is reversible. The changing direction of rotation of the drum also prevents one-sided war of the ends of the chains and extends their useful life.

Figure 1:
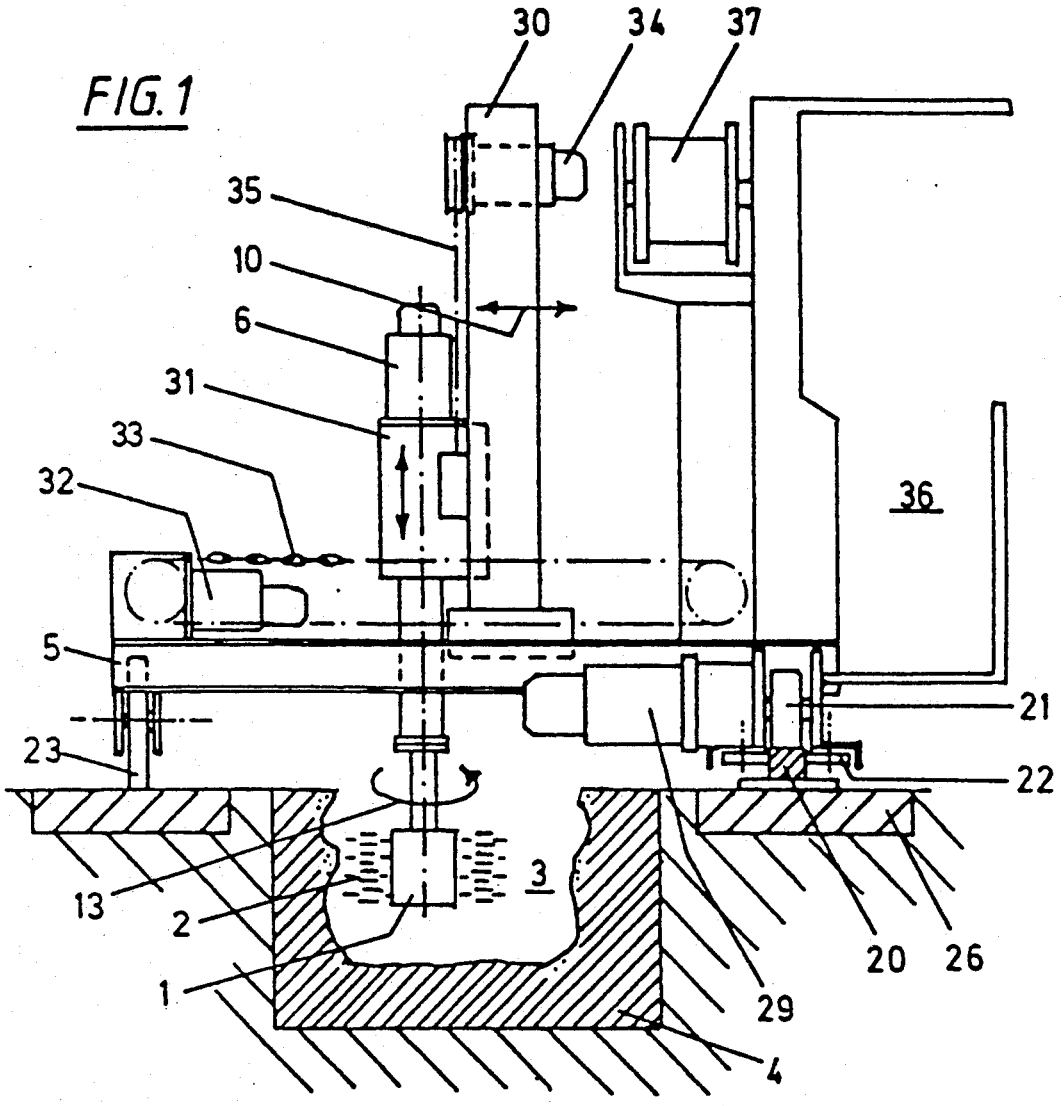
FIG. 1 shows a cross-section through the conveyor trough with a view of the apparatus.

Referring now to FIG. 1, it is shown that on the drum 1 there are a number of chain ends 2. The ends of the chains strike the wall of the conveyor trough 3 and remove slag and worn material from the lining 4. After cleaning, the surface of the trough is relined with new material. The drum 1 is driven by a motor 6, preferably a squirrel cage motor, whose direction of rotation is reversible, the motor 6 being variably operable as a function of the motor.

The apparatus has a movable carriage 5 which extends over the trough 3. The undercarriage 5 is moved by two wheels 21 driven by motors 29. The wheels 21 run on a guide rail 20. For lateral guidance along the rail 20, there are lateral guide rollers 22. On the other side of the trough 3 there is a support wheel 23. On the carriage 5 there is a column 30, which can be moved by means of a lateral displacement motor 32 transverse to the conveyor trough 3 by means of chain traction, preferably a round-link chain 33.

Tension is always applied to the chain 33, so that the displacement of the column does not leave any slack, and thus precision adjustments are possible. Since dust and broken chunks of material can get into the movement mechanism, and there also is a thermal effect caused by the residual heat in the trough, a round-link chain has proven to be a heavy-duty, reliable means of transport for the present apparatus.

The drum 1 and the drive motor 6, which drives the drum, are located on a vertically movable sled 31, which is guided on the column 30. A round-link chain 35, only partly shown in the accompanying drawings, is also preferred for the height adjustment. The height of the sled is adjusted by means of a motor 34.

A measuring device 7 for measuring a load-dependent factor, such as an amperemeter to measure a change in the amount of current absorbed by the motor 6, or a device to measure a change in speed of the motor 6, is provided for motor 6. Also provided is an electrical control circuit 8 which is responsive to a measurement signal, from the measuring device 7, and which transmits a signal to motor 32 for automatic displacement of the drum 1, relative to the wall of the conveyor trough a predetermined distance, in response to the change in resistance offered to the chains 2 by the material of the conveyor trough wall being contacted by the chains 2 during rotation of the drum 1.

The apparatus can be equipped with a control stand 36. The electrical connection can include a cable drum 37, which can be equipped with a device (not shown) to apply tension to the cable. The electrical lines leading to the motor and to the control stand are not shown.

Figure 2:
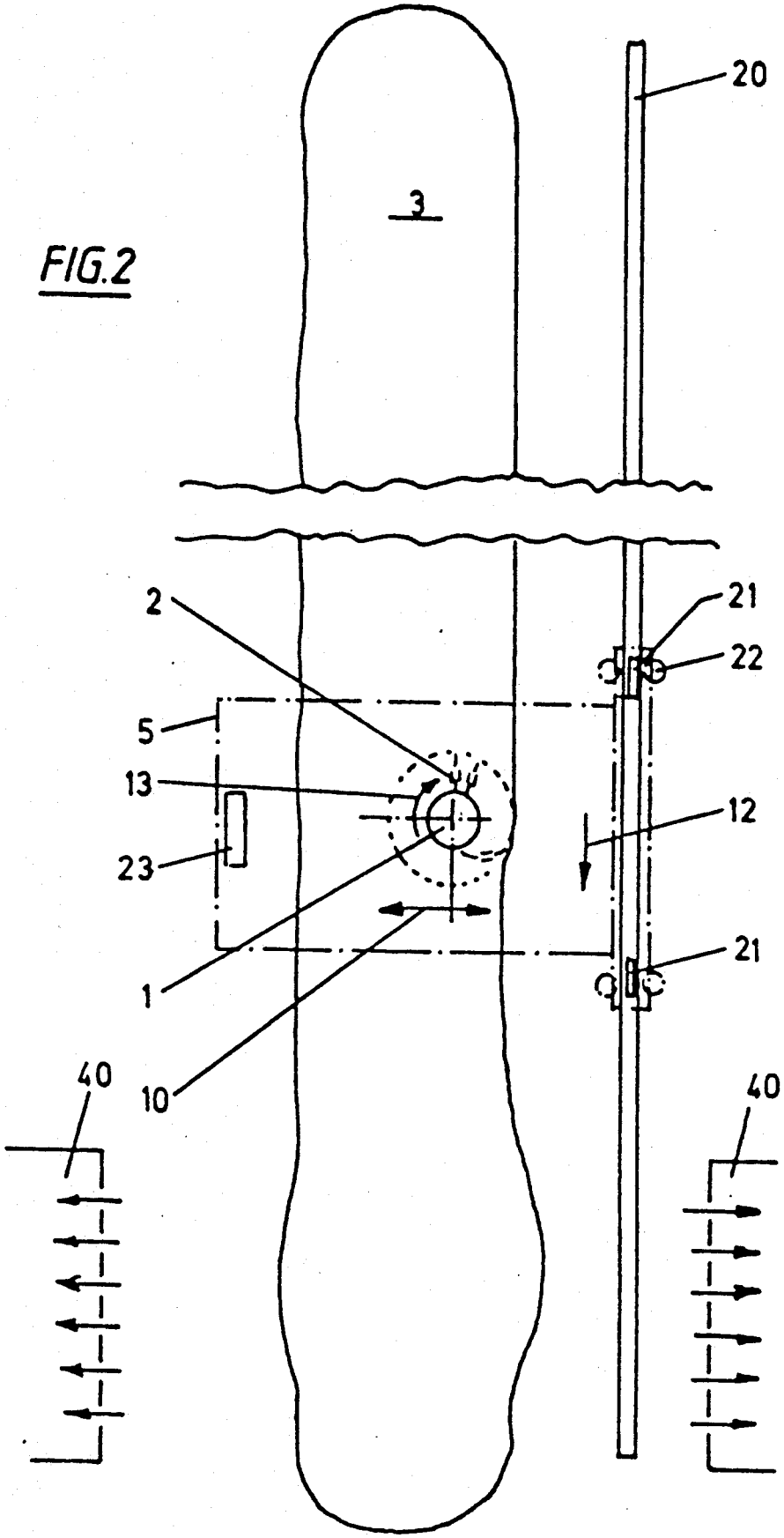
FIG. 2 shows a plan view on the conveyor trough, indicating the apparatus.
Figure 1:
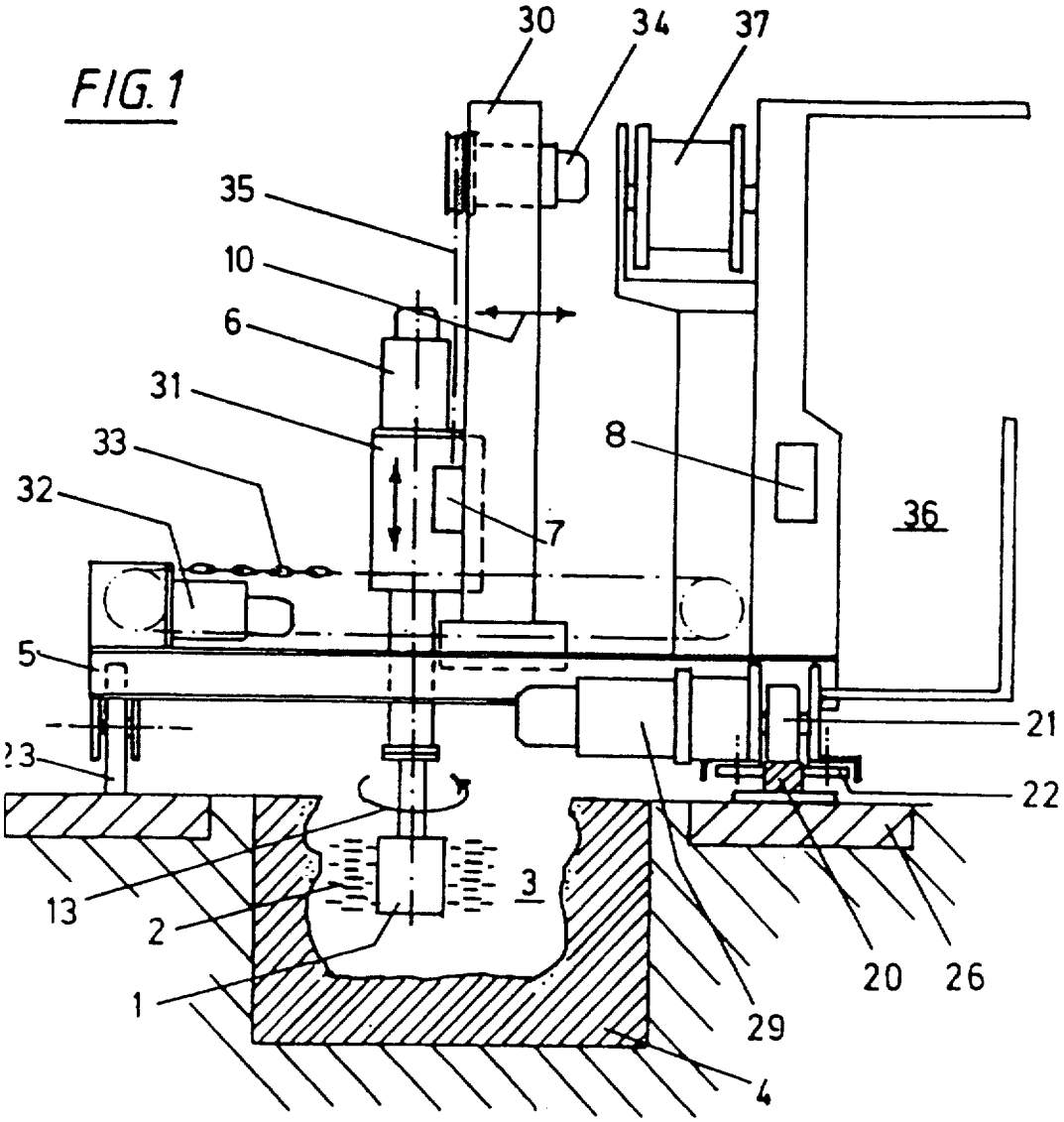

FIG. 2 illustrates the operation of the apparatus. On one end of the conveyor trough 3, e.g. on the end which faces the blast furnace (not shown), there are suction exhaust devices 40 for gases and/or smoke, which can be used during cleaning of the trough to exhaust dust. As the apparatus is propelled by means of the wheels 21, running on the rail 20, in the direction of the arrow 12, the drum 1 with the chains 2 turns in the direction of the arrow 13, e.g., at a speed of 750 rpm. The optimal speed of rotation is always a function of the length of the chain ends and the weight of the chains, and if necessary, on the quality of the wall. A change in the amount of current absorbed by the motor 6 indicates that the contact between the wall and the ends of the chains is no longer the distance considered optimal, so that an adjustment is necessary in the form of a lateral displacement of the drum as shown by arrow 10. This adjustment is necessary on account of different wall conditions, and a wall which curves in individual spots. For example, in the portion of the conveyor in which the pig iron flows, there is more severe wear of the refractory material, so that after some time, the trough becomes wider at this point, requiring an adjustment of the cleaning apparatus. This adjustment can be made automatically as a function of the current consumed by the motor. Since the actual point being cleaned can not be seen by the operator on account of the dust and the undercarriage 5, a follow-up for deviations from the surface of the wall, involving manual lateral displacement of the cleaning apparatus, could previously only be done after the visual inspection of the cleaned wall, not during the cleaning process. Monitoring by the operator, on the basis of the power consumption, naturally makes possible a relatively rapid adjustment, but does not rule out the possibility of operator error. On the other hand, an automatic adjustment is advantageous, in particular on account of the difficult working conditions in the vicinity of a blast furnace.

FIG. 2 illustrates the cleaning of the right-hand wall of the conveyor trough 3. The direction of rotation of the drum 1 is selected so that material removed from the trough is thrown toward the suction exhaust 40. To clean the other wall, the apparatus is returned to its starting position and the drum 1 is moved to the left side. It is operated on that side in the opposite direction of rotation, so that once again the material removed is thrown toward the suction exhaust 40. It is advantageous to provide advance movement on both sides of the trough in the direction indicated by the arrow 12, i.e., toward the suction exhaust 40.

In summary, one feature of the invention resides broadly in a process to clean refractory-lined conveyor troughs for molten metals and slags by means of chains which are located on a rotating drum, the lateral position and height of which can be adjusted on a rail-guided undercarriage, characterized by the fact that to drive the drum, a motor is used, whose current absorption and/or speed of rotation vary as a function of the load, that the change of at least one of these values is measured, and that as a function of the measured value, the distance desired for an optimal cleaning of the wall of the conveyor trough is achieved by a displacement of the rotating drum transverse to the conveyor trough.

Another feature of the invention resides broadly in a process which characterized by the fact that the value measured is converted as the measurement signal in a control circuit into control pulses for the automatic transverse displacement of the drum to match the curvature of the trough wall.

Yet another feature of the invention resides broadly in a process which characterized by the fact that the drum with the chains cleaning the trough wall is rotated in the direction toward a dust suction exhaust device, essentially located at the end of the conveyor trough.

A further feature of the invention resides broadly in an apparatus for the performance of the process consisting of an undercarriage 5 which can move in the longitudinal direction of the conveyor trough, a column 3 which can move transversely, on which is located a rotatable drum 1 whose height can be adjusted and which holds the chains 2, characterized by the fact that to drive the drum, there is a motor 6 reacting to the load resulting from the resistance of the chain ends 2 on the wall of the conveyor trough 3, preferably a squirrel cage motor, on which a vertically-adjustable sled 31 is located on the column 30.

A yet further feature of the invention resides broadly in an apparatus which is characterized by the fact that the direction of rotation of the drum 1 is reversible.

Yet another further feature of the invention resides broadly in an apparatus with a sled 31 which can move vertically on the column 30, wherein the sled 31 supports the drum 1, and with an undercarriage 5 which can move transverse to the conveyor trough, characterized by the fact that the displacement of the column 30 and of the sled 31 takes place by means of a drive using round link chains 33, 35.

All, or substantially all, of the components and methods of the various embodiments may be used with at least one embodiment or all of the embodiments, if any, described herein.

All of the patents, patent applications, and publications recited herein, if any, are hereby incorporated by reference as if set forth in their entirety herein.

The details in the patents, patent applications, and publications may be considered to be incorporable, at applicant's option, into the claims during prosecution as further limitations in the claims to patentably distinguish any amended claims from any applied prior art.

The invention as described hereinabove in the context of the preferred embodiments is not to be taken as limited to all of the provided details thereof, since modifications and variations thereof may be made without departing from the spirit and scope of the invention.

What is claimed is:

1. In a process for cleaning refractory-lined conveyor troughs for molten metals or slags by means of chains which are located on a rotating drum carried by a rail-guided undercarriage, the rotating drum driven by a motor and adjustable in height and lateral position relative to a surface of the trough, the improvement comprising:

providing a motor for driving the drum, said motor being variably operable as a function of the load on the motor resulting from resistance offered to the chains by the material of the conveyor trough surface being contacted by the chains during rotation of the drum;

rotating the drum and the motor to provide contact of the chains with the material on the trough surface;

measuring the load on the motor offered to the chains by the material on the trough surface;

comparing the measured load to a predetermined load;

generating a signal as a result of the comparison to adjust the position of the drum relative to the trough surface; and adjusting the position of the rotating drum relative to the surface of the conveyor trough a predetermined distance in response to said signal so as to achieve optimal cleaning of the conveyor surface, said adjusting the position of the drum relative to the surface comprising:

increasing the distance of the drum to the surface when the measured load is substantially greater than the predetermined load, and decreasing the distance of the drum to the surface when the measured load is substantially less than the predetermined load.

2. In a process for cleaning refractory-lined conveyor troughs for molten metals or slags as defined in claim 1, the improvement wherein the current absorption of the motor driving the drum varies as a function of the load on the motor resulting from said resistance.

3. In a process for cleaning refractory-lined conveyor troughs for molten metals or slags as defined in claim 2, the improvement comprising:

measuring a change in current absorption of the motor; and converting the change in current absorption of the motor in a control circuit into control pulses for automatically adjusting the position of the rotating drum to provide optimal cleaning of the conveyor trough surface.

4. In a process for cleaning refractory-lined conveyor troughs for molten metals or slags as defined in claim 1, the improvement the speed of the motor the drum varies as a function of the load on the motor resulting from said resistance.

5. In a process for cleaning refractory-lined conveyor troughs for molten metals or slags as defined in claim 4, the improvement comprising:

measuring a change in speed of the motor; and converting the change in speed of the motor in a control circuit into control pulses for automatically adjusting the position of the rotating drum to provide optimal cleaning of the conveyor trough surface.

6. In a process for cleaning refractory-lined conveyor troughs for molten metals or slags as defined in claim 1, the improvement wherein rotation of said drum and the chains thereon is in the direction such that the chains striking the trough surface, strike the trough surface in a direction of rotation towards a dust suction exhaust device located adjacent the end of the conveyor trough.

7. In an apparatus for cleaning refractory-lined conveyor troughs for molten metals or slags having a rotatable drum with chains for contact with a surface of the trough, the rotatable drum driven by a motor and adjustable in height and lateral position relative to the surface of the trough, the apparatus having an undercarriage moveable longitudinally along the conveyor trough, and a column moveable transversely on which the rotatable drum is carried and along which the height of the drum can be adjusted, the improvement comprising:

a variably operable motor for driving the drum, said motor responsive to the load resulting from resistance offered to the chains by the material of the conveyor trough surface contacted by the chains during rotation of the drum;

means for measuring the load on the motor;

means for comparing the measured load to a predetermined load and generating a signal for adjusting the position of the drum relative to the surface;

means for adjusting the position of the drum relative to the surface as a function of the load, said means for adjusting comprising:

means for increasing the distance of the drum to the surface when the measured load is substantially greater than the predetermined load, and means for decreasing the distance of the drum to the surface when the measured load is substantially greater than the predetermined load, and means for connecting the signal from said comparing means to said position adjusting means to adjust the position of the drum to substantially optimize cleaning of the trough.

8. In an apparatus for cleaning refractory-lined conveyor troughs for molten metals or slags as defined in claim 7, the improvement wherein said means for comparing comprises electrical control circuit which is responsive to a measurement signal from said means for measuring and which transmits a signal to said position adjusting means for automatic adjustment of the position of the drum relative to the surface of the trough.

9. In an apparatus for cleaning refractory-lined conveyor troughs for molten metals or slags as defined in claim 8, the improvement wherein said motor is a squirrel cage motor, and a vertically moveable sled is provided on said column on which said rotatable drum and squirrel cage motor are located.

10. In an apparatus for cleaning refractory-lined conveyor troughs for molten metals and slags as defined in claim 8, the improvement wherein said rotatable drum is reversible in direction of rotation.

11. In an apparatus for cleaning refractory-lined conveyor troughs for molten metals and slags as defined in claim 8, the improvement wherein round link chains are provided for vertical movement of said sled and for the transverse movement of said column.

12. In an apparatus for cleaning refractory-lined conveyor troughs for molten metals or slags having a rotatable drum with chains for contact with at least one surface of the trough, the rotatable drum driven by a motor and adjustable in height and lateral position relative to the at least one surface of the trough, the apparatus having an undercarriage moveable longitudinally along the conveyor trough, and a column moveable transversely on which the rotatable drum is carried and along which the height of the drum can be adjusted, the improvement comprising:

a variably operable motor for driving the drum, said motor responsive to the load resulting from resistance offered to the chains by the material of the at least one conveyor trough surface contacted by the chains during rotation of the drum; and means for automatically adjusting the position of the drum relative to the at least one surface, said automatic adjusting means comprising:

means for measuring the load on the motor;

means for comparing the measured load to a predetermined load and generating a signal for adjusting the position of the drum relative to the at least one surface;

means for automatically adjusting the position of the drum relative to the at least one surface as a function of the load, said automatic adjusting means comprising:

means for automatically increasing the distance of the drum to the at least one surface when the measured load is substantially greater than the predetermined load, and means for automatically decreasing the distance of the drum to the at least one surface when the measured load is substantially less than the predetermined load; and means for connecting the signal from said comparing means to said automatic position adjusting means to automatically adjust the position of the drum relative to the trough surface to substantially optimize cleaning of the trough.

13. In an apparatus for cleaning refractory-lined conveyor troughs for molten metals or slags as defined in claim 12, the improvement said means for comparing comprises an electrical control circuit which is responsive to a measurement signal from said means for measuring and which transmits a signal to said position adjusting means for automatic adjustment of the position of the drum relative to the surface of the trough.

14. In an apparatus for cleaning refractory-lined conveyor troughs for molten metals or slags as defined in claim 13, the improvement wherein said motor is a squirrel cage motor, and a vertically moveable sled is provided on said column on which said rotatable drum and squirrel cage motor are located.

15. In an apparatus for cleaning refractory-lined conveyor troughs for molten metals and slags as defined in claim 13, the improvement wherein said rotatable drum is reversible in direction of rotation.

16. In an apparatus for cleaning refractory-lined conveyor troughs for molten metals and slags as defined in claim 13, the improvement wherein round link chains are provided for vertical movement of said sled and for the transverse movement of said column.

* * * * *

UNITED STATES PATENT AND TRADEMARK OFFICE

CERTIFICATE OF CORRECTION

PATENT NO. : 5,014,965

DATED : May 14, 1991

INVENTOR(S) : Heinrich Kaiser

It is certified that error appears in the above-indentified patent and that said Letters Patent is hereby corrected as shown below:

Drawings:

Title page should be deleted and substitute therefor the attached title page.

Delete drawing sheet 1 of 2 and substitute therefor the drawing sheet, consisting of Fig 1, as shown on the attached page.

United States Patent [19]

Kaiser

[11] Patent Number: 5,014,965

[45] Date of Patent: May 14, 1991

[54] PROCESS AND APPARATUS TO CLEAN A MOLTEN METAL OR SLAG CONVEYOR TROUGH

[75] Inventor: Heinrich Kaiser, Salzgitter, Fed. Rep. of Germany

[73] Assignee: Stahlwerke Peine-Salzgitter AG, Peine, Fed. Rep. of Germany

[21] Appl. No.: 505,050

[22] Filed: Apr. 4, 1990

[51] Int. Cl.[5] ..... C21B 9/10

[52] U.S. Cl. ..... 266/44; 266/281; 266/135

[58] Field of Search ..... 266/45, 44, 281, 280, 266/135, 78, 287; 264/30

[56] References Cited

U.S. PATENT DOCUMENTS 4,871,211 10/1989 Aussel ..... 266/281

4,923,180 5/1990 Eitel ..... 266/281

FOREIGN PATENT DOCUMENTS 3225015 11/1983 Fed. Rep. of Germany .

689771 1/1930 France .

2037007 4/1969 France .

*Primary Examiner*—S. Kastler

*Attorney, Agent, or Firm*—Thomas N. Ljungman

[57] ABSTRACT

A process and apparatus to clean refractory-lined conveyor troughs for molten metals and slags by means of chains on a rotating drum. A motor is used to drive the drum, whose current consumption and/or speed are variable as a function of the load. Variation from a specified setpoint is used to cause a displacement of the rotating drum transverse to the conveyor trough, to achieve optimal cleaning of the trough wall, which is only effected with the desired distance between wall and drum and a load on the motor corresponding to this distance. The direction of rotation of the drum is reversible, so that when the two sides of the conveyor trough are cleaned, the material removed is thrown in the same direction, preferably towards a suction exhaust.

16 Claims, 2 Drawing Sheets

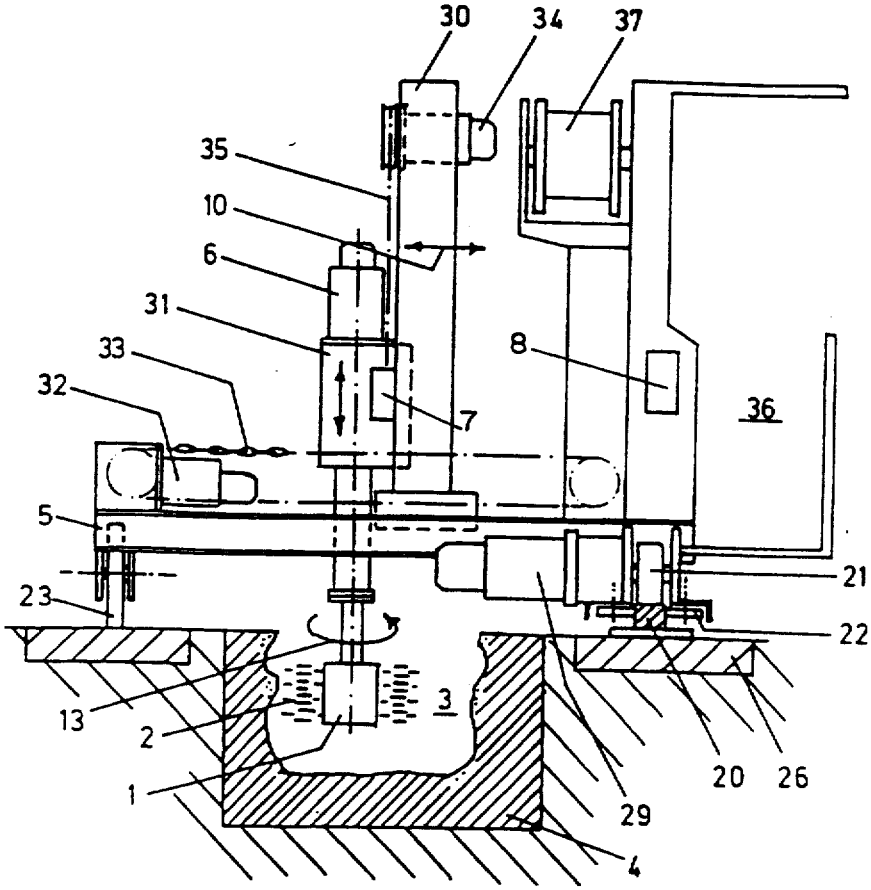

UNITED STATES PATENT AND TRADEMARK OFFICE

CERTIFICATE OF CORRECTION

PATENT NO. : 5,014,965

DATED : May 14, 1991

INVENTOR(S) : Heinrich KAISER

It is certified that error appears in the above-indentified patent and that said Letters Patent is hereby corrected as shown below:

After INID [22], insert the following Continuing Application Data:

--Related International Application Data
[63] Continuation-in-part of International Application No. PCT/DE89/00500, filed August 1, 1989, which was published February 22, 1990, as WO/90/01665--.

After INID [22], insert the following Foreign Priority Data:

-- [30] Foreign Application Priority Data
August 12, 1988 [DE] Fed. Rep. of Germany 3827400--.

In column 1, after the title, insert the following:

--CONTINUING APPLICATION DATA

The present U.S. application is a continuation-in-part of U.S. Serial No. 07/546,546, filed on June 29, 1990. This application is also a continuation-in-part of International Application No. PCT/DE89/00500, filed on August 1, 1989, which was published on February 22, 1990 as WO/90/01665.

In column 2, line 36, after 'chains' delete "troughs".

UNITED STATES PATENT AND TRADEMARK OFFICE

CERTIFICATE OF CORRECTION

PATENT NO. : 5,014,965

DATED : May 14, 1991

INVENTOR(S) : Heinrich KAISER

It is certified that error appears in the above-indentified patent and that said Letters Patent is hereby corrected as shown below:

In column 3, line 38, after 'one-sided', delete "war" and insert --wear--.

In column 6, line 54, Claim 4, after 'improvement' insert --wherein--.

In column 7, lines 32-33, Claim 7, after 'substantially', delete "greater" and insert --less--.

Signed and Sealed this

Seventeenth Day of December, 1996

*Attest:*

*Attesting Officer*

Bruce Lehman

BRUCE LEHMAN

*Commissioner of Patents and Trademarks*